US005915687A

United States Patent [19]

Rieck

[11] Patent Number: 5,915,687

[45] Date of Patent: Jun. 29, 1999

[54] PRINTER HIGH CAPACITY OUTPUT STACKER DOCUMENTS REMOVAL SYSTEM

[75] Inventor: Kenneth J. Rieck, Victor, N.Y.

[73] Assignee: Xerox Corporation, Stamford, Conn.

[21] Appl. No.: 08/925,250

[22] Filed: Sep. 8, 1997

[51] Int. Cl.[6] ..... B65H 31/00

[52] U.S. Cl. ..... 271/207; 271/213

[58] Field of Search ..... 271/207, 213, 271/220; 206/215; 414/789.9, 790.1

[56] References Cited

U.S. PATENT DOCUMENTS

| | | | |
|---|---|---|---|
| 4,155,643 | 5/1979 | Ladds et al. | 271/207 X |
| 5,172,906 | 12/1992 | Dole | 271/215 |
| 5,666,630 | 9/1997 | Zoltner et al. | 399/405 |

*Primary Examiner*—William E. Terrell
*Assistant Examiner*—Gene O. Crawford

[57] ABSTRACT

A printed sheets stacking, removal, transporting and containment system for the large heavy stacks of printed sheets outputted by a reproduction apparatus with a plurality of separate sheet stack transporting tote units, each adapted to lift and retain a large stack of printed sheets, each tote unit having a bottom surface, enclosing side surfaces, and an open side through which a large stack of sheets can be laterally loaded, and also having at least one integral keying member, preferably an integral runner extending from the bottom surface and extending in the direction of the open side, with a downwardly beveled outer end; and the output stacking tray having at least one guide member designed to temporarily removably mate with the keying member to guide the tote unit on the stacking tray under the large stack of sheets so that they may be lifted and transported away from the output stacking tray retained in the tote unit. The guide member may comprise at least one guide channel extending below the sheet stacking surface of the output tray. The bottom surface of the tote unit may also terminates in a V shaped downwardly beveled outer edge at its open side.

6 Claims, 5 Drawing Sheets

PRINTER HIGH CAPACITY OUTPUT STACKER DOCUMENTS REMOVAL SYSTEM

Disclosed in the embodiments herein is an improved, more reliable, and safer system for accumulating, handling and transporting large stacks of printed sheets outputted at the sheet stacking output of copiers, printers and other reproduction apparatus.

In particular, there is disclosed a low cost and simple integrated output sheet stacking and output removal or "tote" system by which large stacks of sheets can be easily removed from an output stacking tray of a reproduction apparatus and carried over to other further processing or mailing machines or stations, such as binders and other finishers, with a system which greatly reduces damage, disruption or loss of order of the sheets, as compared to the usual operator manual removals of stacks of sheets from reproduction machine output trays.

In high speed, high volume, printers or copiers, the print job sets must be frequently unloaded from the output stacking tray. Removing large stacks of documents from output trays can be a difficult task. It is not unusual to see heavy stacks of 1,000 to 1,500 sheets accumulated on a stacker tray waiting for someone to remove and distribute them. The system of the disclosed embodiments provides a simple and low cost way for people to easily remove the entire stack from the output tray without dropping, damaging or messing up the order of the stack. It also provide a way for customers to carry these large stacks back to their desks or to meetings for distribution. Several of the disclosed totes may be stationed near a reproduction machine for use when needed.

Furthermore, such high volume reproduction machines typically are shared usage or copy center machines, with many different print jobs from many different users, which separate print jobs must be kept separated, and not accidentally mixed together or confused. The present system provides a low cost and convenient system for removing and maintaining plural separate print jobs in separate containers even though commonly outputted at the same output stacking tray.

Particularly noted by way of background as to the presently disclosed system is Xerox Corp. U.S. Pat. No. 5,172,906 issued Dec. 22, 1992 to Otto R. Dole. See, e.g, FIG. 8, showing a removable output sheet stacking tray bin or container.

As to reproduction systems and output trays per se, it will be appreciated that there are numerous types of elevator stacking trays and other sheet output stackers known in the art, with which the present system could be incorporated. The following U.S. patent disclosures are noted merely as a few examples: U.S. Pat. Nos. 5,098,074; 4,137,265; 5,026,034; 4,541,763; 4,880,350. Of particular interest is Xerox Corp. U.S. Pat. No. 5,396,321 issued Mar. 7, 1995 to Freddie McFarland, et al, which shows stacking finished sheet sets on an elevator stacker with integral partially extendible translatably driven rails 201 and other means for moving the stack into a directly adjacent auxiliary device. Additional elevator stacking and/or set delivery system patents are cited in Cols. 1 and 2 thereof.

In reproduction apparatus such as xerographic and other copiers and printers, or multifunction machines, it is increasingly important in general to provide more reliable handling of the physical image bearing substrate sheets, which can vary widely in size, weight, strength, and other characteristics. In particular, to avoid bending, curling, folding or otherwise damaging sheets so that they will not subsequently reliably feed or process.

A specific feature of the specific embodiments disclosed herein is to provide a printed sheets stacking, removal, transporting and containment system for reproduction apparatus in which the printed sheets outputted by the reproduction apparatus are stacked in large stacks on the sheet stacking surface of an output stacking tray; comprising a plurality of separate sheet stack transporting tote units, each adapted to lift and retain a large stack of said printed sheets therein; each of said sheet stack transporting tote units having a bottom surface, enclosing side surfaces, and an open side through which a large stack of said printed sheets can be laterally loaded into said sheet stack transporting tote unit to be held and transported in said sheet stack transporting tote unit; each of said sheet stack transporting tote units also having at least one integral keying member; and said output stacking tray having at least one guide member designed to only temporarily removably mate with said keying member to guide said bottom surface of an individual said sheet stack transporting tote unit on said output stacking tray under a large stack of said printed sheets on said output stacking tray so that said large stack of said printed sheets on said output stacking tray may be lifted and transported away from said output stacking tray retained in said sheet stack transporting tote unit.

Further specific features disclosed herein, individually or in combination, include those wherein said guide member comprises at least one guide channel extending below said sheet stacking surface of said output stacking tray adapted to receive and guide said keying member therein; and/or wherein said guide member comprises at least one guide channel extending below said sheet stacking surface of said output stacking tray adapted to receive and guide said keying member therein; and wherein said keying member comprises an integral runner extending from said bottom surface of said sheet stack transporting tote unit and extending in the direction of said open side of said sheet stack transporting tote unit; and/or wherein said keying member comprises an integral runner extending from said bottom surface of said sheet stack transporting tote unit and extending in the direction of said open side of said sheet stack transporting tote unit and having a beveled outer end for assisting said keying member in guiding said bottom surface of said sheet stack transporting tote unit under a large stack of said printed sheets on said output stacking tray stacking surface; and/or wherein said keying member comprises an integral runner extending both upwardly and downwardly from said bottom surface of said sheet stack transporting tote unit and extending in the direction of said open side of said sheet stack transporting tote unit and having a downwardly beveled outer end for assisting said keying member in guiding said bottom surface of said sheet stack transporting tote unit under a large stack of said printed sheets on said output stacking tray stacking surface with said upward extension of said integral runner extending above said stacking surface for partially intermediately lifting said large stack of said printed sheets; and/or wherein said bottom surface of said sheet stack transporting tote unit terminates in a V shaped downwardly beveled outer edge at said open side of said sheet stack transporting tote unit.

In the description herein the terms "sheet" or "document" refers to usually flimsy physical sheets of paper, plastic, or other suitable physical substrate for printing images thereon, whether precut or initially web fed and then cut. A "copy sheet" may be abbreviated as a "copy", or called a "hardcopy". A "job" is normally a set of related sheets, usually a collated copy set copied from a set of original document sheets or electronic document page images, from a particular user, or otherwise related.

As to specific components of the subject apparatus, or alternatives therefor, it will be appreciated that, as is normally the case, some such components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background. What is well known to those skilled in the art need not be described here.

Various of the above-mentioned and further features and advantages will be apparent from the specific apparatus and its operation described in the examples below, and the claims. Thus, the present invention will be better understood from this description of specific embodiments, including the drawing figures (approximately to scale) wherein:

Figure 5:
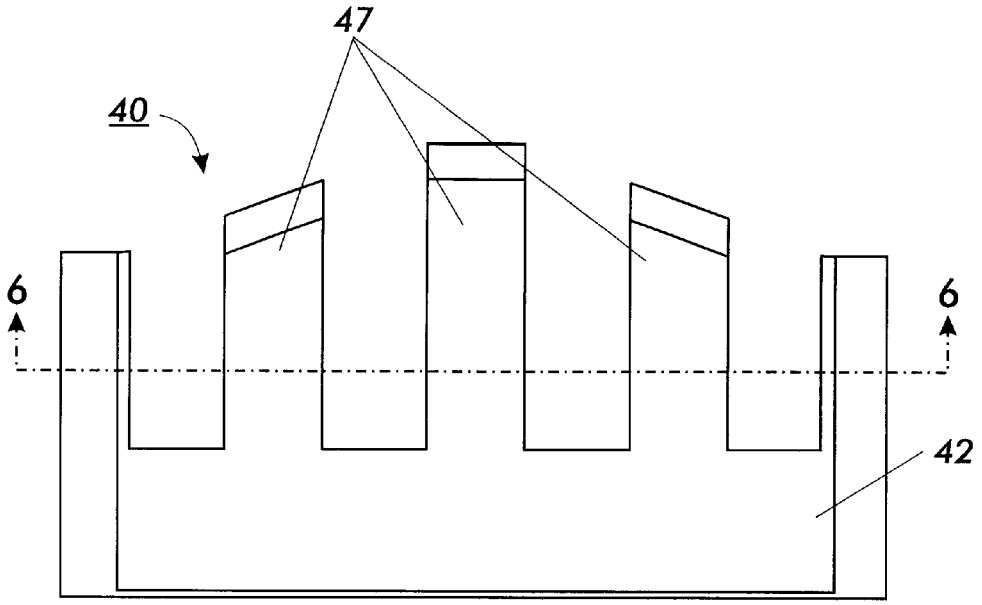
FIG. 5 is a top view of another, different, exemplary tote unit per se.
Figure 6:
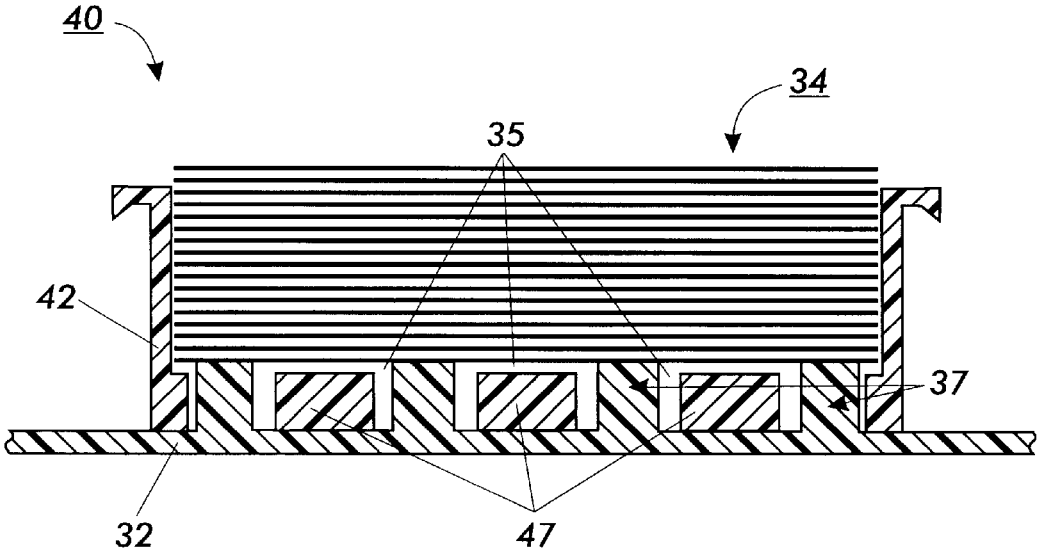
FIG. 6 is a cross-sectional view of the exemplary tote unit of FIG. 5 in operating position in an exemplary mating printer output stacking tray.

Describing now in further detail the exemplary embodiments with reference to the Figures, there is shown a reproduction machine 10, with an output stacking tray 12, by way of one example thereof, in the embodiment of FIGS. 1–4, and a slightly different stacking tray 32 in the second system embodiment of FIGS. 5 and 6. As will be described, the normal output stacking tray 12 is slightly modified here as part of an integral tote system 20 for removable totes such as 22 mateable with tray 12, and likewise the output stacking tray 32 is slightly modified here as part of another exemplary integral tote system 40 for removable totes such as 42.

The totes 22 and 42 provide low cost, light weight, easily liftable and transportable containers to assist in the removal of large quantities of documents from an output tray of a copier, printer, offset printer, finisher/finished sets stacker, or other such paper handling device. They may be molded as shown, or designed with integral fold line hinges to be folded or collapsed for easier storage and shipping. As will be seen, the design of the integrated tote systems 20 or 40 allows the tote containers 22 or 42 to be slipped, one at a time, (after each print job to be separated and removed is finished) under even a very large quantity of paper stacked in an output tray 12 or 32, without damaging that stack, and to securely retain that stack 14 or 34 before, during and after simple easy removal with the tote 22 or 42 from the output tray 12 or 32.

As shown, the output trays 12 and 32 here have an integral tote mating system with open ended grooves or tracks to provide the disclosed functions, and to provide for removal and transport of large stacks of paper without damage to the paper. Operators can easily remove a large stack of documents from the output tray of a stacker in one simple operation. The totes 22, 42 themselves can each be a simple one piece molded plastic bucket. As shown, each tote is preferably designed with three full sides and a sheet supporting bottom, for full support of even flimsy sheets.

The tote 22 here is keyed to the stacker tray 12 via a molded-in tote runner 27 dimensioned to slide into a corresponding groove or slot 17 in the upper surface of the tray 12 to provide the tote mating system. The front of the tote 22 runner 27 has a downwardly inclined or beveled front lifting surface 28.

Figure 1:
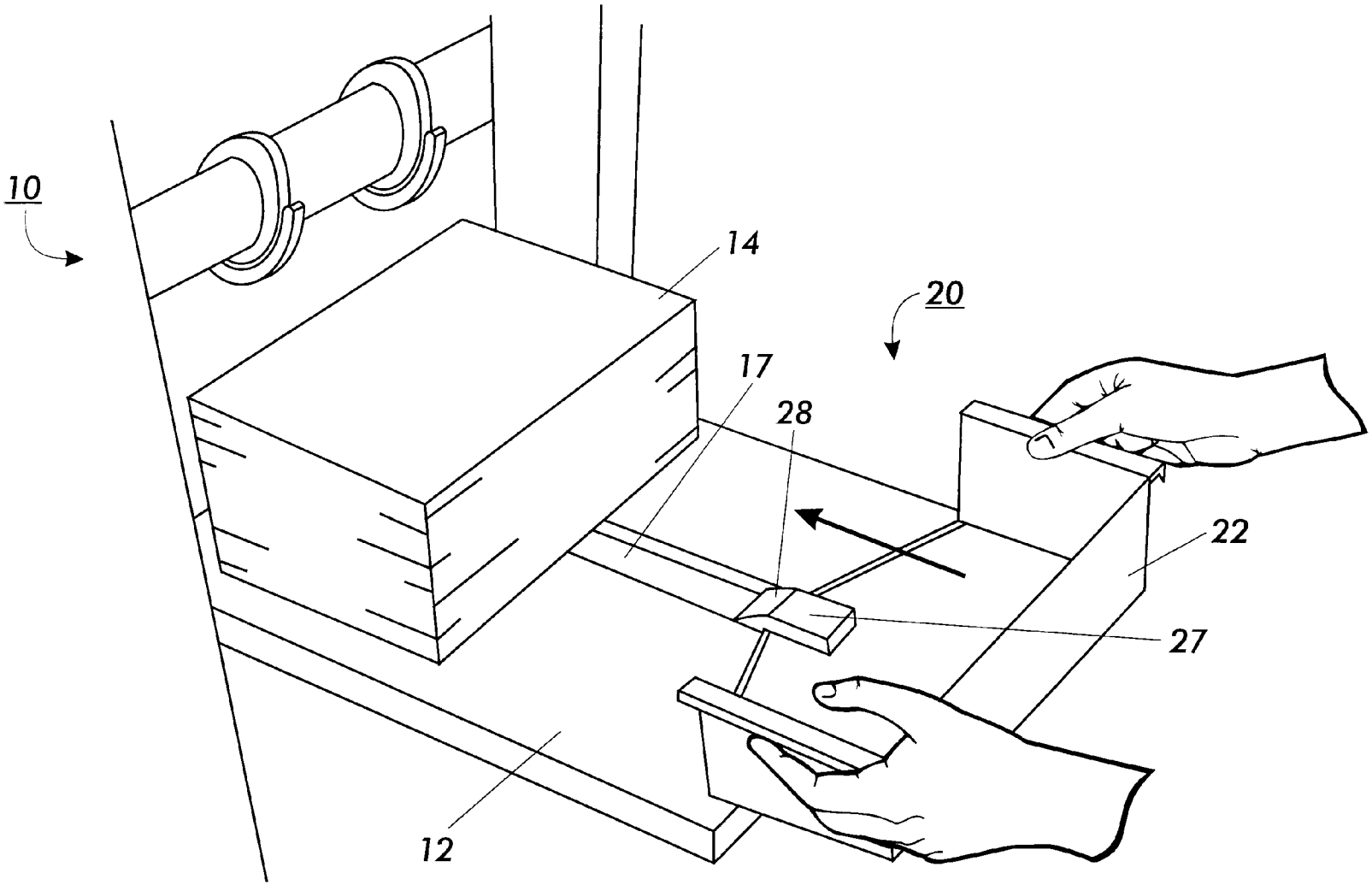
FIG. 1 is a frontal perspective view of one embodiment of the disclosed system, showing, as a first step, an exemplary tote unit being initially inserted into an exemplary mating printer output stacking tray.
Figure 2:
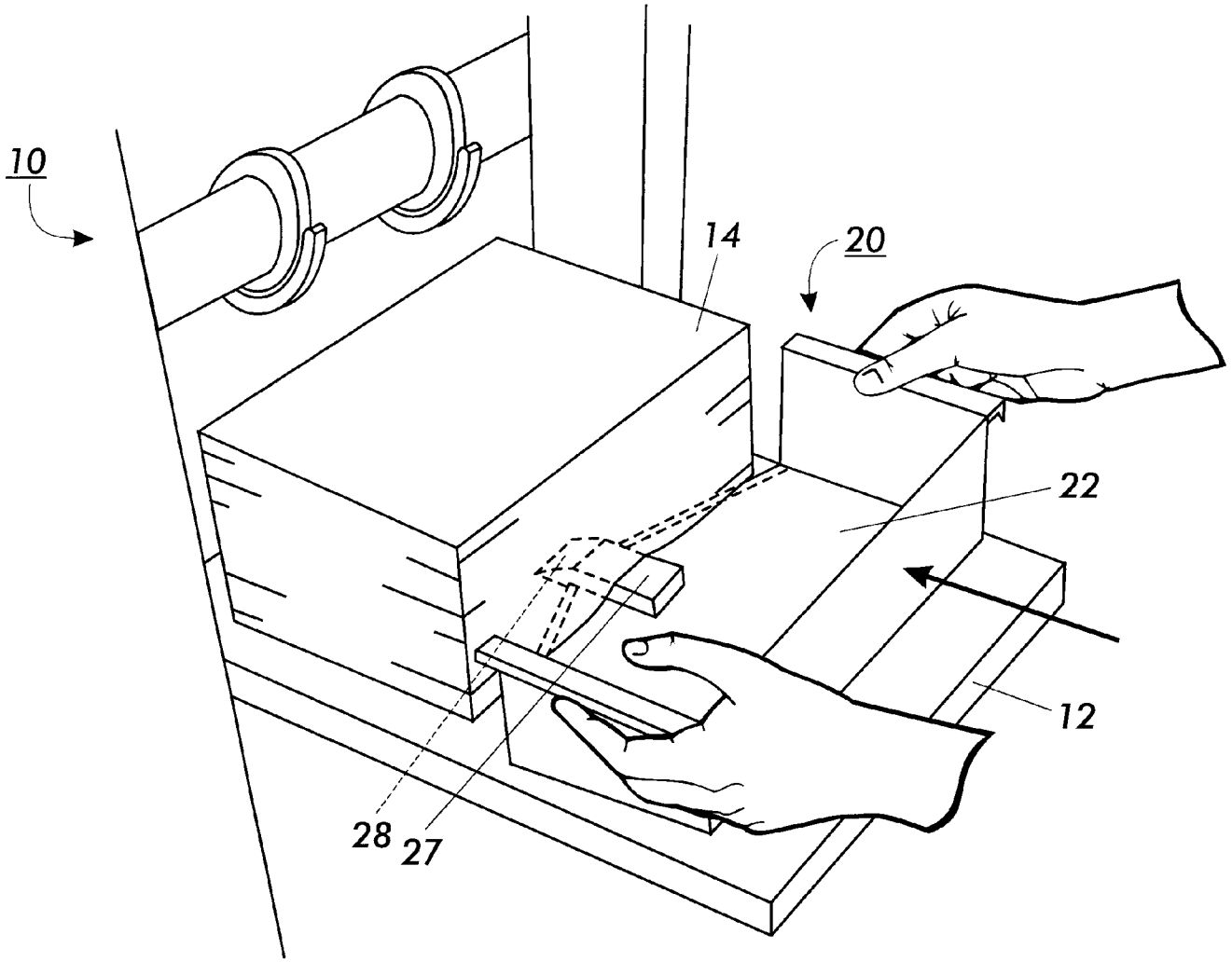
FIG. 2 is the same view as FIG. 1, showing, as a second step, the same exemplary tote unit being further inserted, at the point at which it starts to be inserted under the stack of sheets in that output stacking tray.
Figure 3:
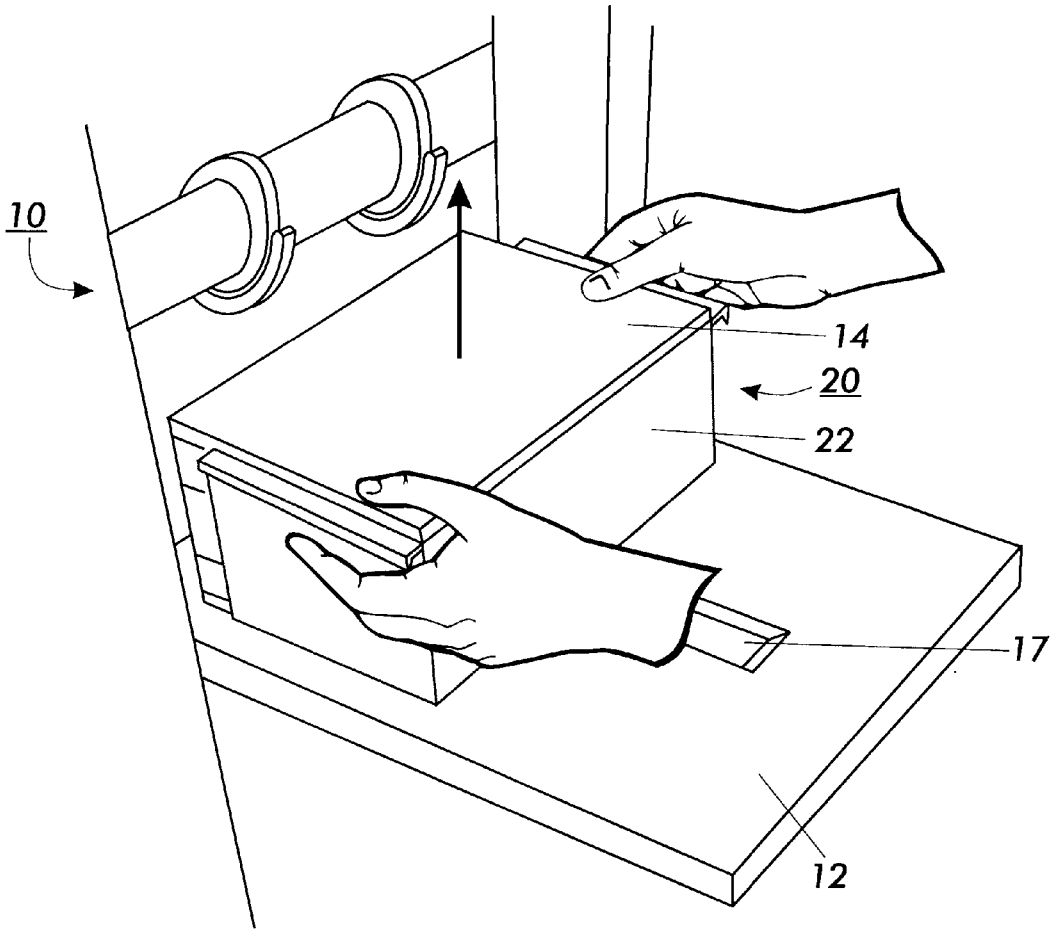
FIG. 3 is a similar view to FIGS. 1 and 2, at a different perspective angle, showing, as a third step, the same exemplary tote unit being further inserted, at the point at which it is fully inserted under the stack of sheets in that output stacking tray, and starting to lift away that stack.
Figure 4:
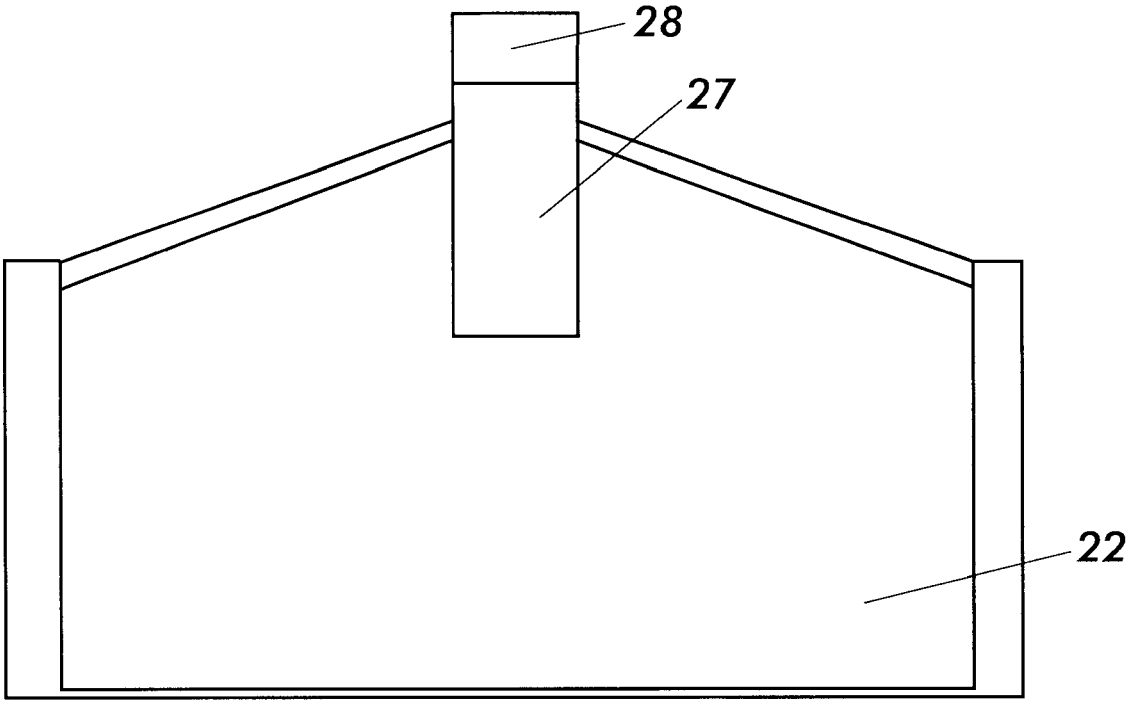
FIG. 4 is a top view of the exemplary tote unit per se of FIGS. 1–3.

As shown in sequential steps in FIGS. 1 through 3, the tote 22 is placed in position at the outside end of the tray 12, with the open end of the tote facing the stack, and with runner 27 in the open end of groove 17, and then the tote 22 is pushed into the tray 12 towards the stack 14, with runner 27 guided down groove 17. As the lifting inclined plane front surface 27 reaches the outer stack edge, that front edge 27 of the runner 27 lifts the paper stack slightly, high enough to allow the tapered front edge 28 of the tote to be fully inserted under the stack without damaging the sheets. The operator can then simply lift up the tote 22 by its side wall handles 29 and remove the entire stack therein.

Turning now to the system 40 embodiment, it differs in that the bottom of the tote 42 comprises plural fingers 47, slidable in mating commonly transversely spaced plural grooves 35 in the tray 32. The height of the fingers 47 are less than the depth of the grooves 35, so that the fingers 47 do not extend above the stack supporting surfaces 37 of the tray 32. Thus, the bottom of the tote 42 can slide under the stack 34 without contacting or lifting the stack at all. When the tote 42 is lifted, the fingers 47 are closely enough spaced together, and cover a large enough area, such that they hold even flimsy sheets from falling out of the tote bottom between the fingers.

While the embodiments disclosed herein are preferred, it will be appreciated from this teaching that various alternatives, modifications, variations or improvements therein may be made by those skilled in the art, which are intended to be encompassed by the following claims.

What is claimed is:

1. A printed sheets stacking, removal, transporting and containment system for the printed sheets output of a reproduction apparatus in which the printed sheets outputted by the reproduction apparatus are stacked in a large stack; comprising:

a sheet stacking tray with a sheet stacking surface for receiving the stack of printed sheets;

a sheet stack transporting tote unit, adapted to lift and retain a large stack of said printed sheets therein;

said sheet stack transporting tote unit being a separate unit slidably mountable on said sheet stacking tray to slide under said large stack on said sheet stacking surface thereof and be manually liftable away from said sheet stacking tray to remove said large stack therein;

said sheet stack transporting tote unit having a bottom surface, manual lifting side surfaces, and an open side through which a large stack of said printed sheets can be laterally loaded into said sheet stack transporting tote unit to be held and transported in said sheet stack transporting tote unit;

said sheet stack transporting tote unit also having at least one integral keying member; and said sheet stacking tray having at least one guide member designed to temporarily removably mate with said keying member to guide said bottom surface of said sheet stack transporting tote unit under said large stack of said printed sheets on said sheet stacking tray so that said large stack of said printed sheets on said sheet stacking tray may be lifted and transported away from said sheet stacking tray retained in said sheet stack transporting tote unit.

2. The printed sheets stacking, removal, transporting and containment system of claim 1 wherein said guide member comprises at least one guide channel extending below said sheet stacking surface of said output stacking tray adapted to receive and slideably guide said keying member therein.

3. The printed sheets stacking, removal, transporting and containment system of claim 1 wherein said guide member comprises at least one guide channel extending below said sheet stacking surface of said output stacking tray adapted to receive and guide said keying member therein; and wherein said keying member comprises an integral runner extending from said bottom surface of said sheet stack transporting tote unit and extending in the direction of said open side of said sheet stack transporting tote unit.

4. The printed sheets stacking, removal, transporting and containment system of claim 1 wherein said keying member comprises an integral runner extending from said bottom surface of said sheet stack transporting tote unit and extending in the direction of said open side of said sheet stack transporting tote unit and having a beveled outer end for assisting said keying member in guiding said bottom surface of said sheet stack transporting tote unit under said large stack of said printed sheets on said sheet stacking tray sheet stacking surface.

5. The printed sheets stacking, removal transporting and containment system of claim 1 wherein said keying member comprises an integral runner extending both upwardly and downwardly from said bottom surface of said sheet stack transporting tote unit and extending in the direction of said open side of said sheet stack transporting tote unit and having a downwardly beveled outer end for assisting said keying member in guiding said bottom surface of said sheet stack transporting tote unit under any printed sheets on said sheet stacking tray sheet stacking surface with said upward extension of said integral runner extending above said sheet stacking surface for partially intermediately lifting said printed sheets.

6. The printed sheets stacking, removal, transporting and containment system of claim 1 wherein said bottom surface of said sheet stack transporting tote unit terminates in a V shaped downwardly beveled outer edge at said open side of said sheet stack transporting tote unit.

* * * * *